US005513885A

United States Patent [19]

Joffe

[11] Patent Number: 5,513,885

[45] Date of Patent: May 7, 1996

[54] BOTTLE GRIP

[76] Inventor: Diane Joffe, 420 E. 72nd St. Apt. 5A, New York, N.Y. 10021

[21] Appl. No.: 290,316

[22] Filed: Aug. 15, 1994

[51] Int. Cl.[6] ..... A61J 9/06; B65D 23/10

[52] U.S. Cl. ..... 294/31.2; 215/396; 248/102; 294/33

[58] Field of Search ..... 294/27.1, 31.2, 294/33, 87.2, 99.1, 137, 148, 166; 215/11.1, 386, 392, 395, 396; 220/694, 724, 732, 737, 752, 756, 758, 768; 248/102–106, 311.2, 312

[56] References Cited

U.S. PATENT DOCUMENTS

| | | | |
|---|---|---|---|
| 378,361 | 2/1888 | Fox | 215/395 |
| 811,742 | 2/1906 | Petrie | 215/392 |
| 1,965,638 | 7/1934 | Gerhardt | 294/99.1 |
| 2,227,780 | 1/1941 | Hickman et al. | 294/27.1 |
| 2,655,403 | 10/1953 | Ernest | 294/33 |
| 2,759,756 | 8/1956 | Sikora | 294/31.2 |
| 3,058,708 | 10/1962 | Murray et al. | 248/102 |
| 3,463,536 | 8/1969 | Updegraff et al. | 294/31.2 |
| 4,247,142 | 1/1981 | Erickson | 294/87.2 |
| 5,183,229 | 2/1993 | Duggan | 248/102 |

FOREIGN PATENT DOCUMENTS

| | | | |
|---|---|---|---|
| 4154550 | 5/1992 | Japan | 220/737 |

*Primary Examiner*—Johnny D. Cherry
*Attorney, Agent, or Firm*—Paul J. Sutton; David Teschner

[57] ABSTRACT

A rim to be placed upon a baby bottle to permit positioning and manipulation of the bottle by the baby feeding from such bottle. The outer surface of the rim has a number of flats to prevent the rim rolling along a surface. A number of flexible fingers project towards the center to receive and hold a baby bottle inserted therein.

4 Claims, 2 Drawing Sheets

BOTTLE GRIP

BACKGROUND OF THE INVENTION

1. Field of Invention

The invention is directed to a device which permits a bottle to be gripped, manipulated or placed in a fixed position upon a surface and more particularly to a device which can be placed about a baby bottle to permit the bottle to be gripped and manipulated or fixed with respect to a surface to permit the baby to feed from such bottle.

2. Description of the Prior Art

A known prior art device used a collar which was screwed onto the bottle and had a series of legs extending from it about the bottle. A support was snapped onto the legs to support the bottle. However, the support often separated from the legs providing a series of objects which could easily injure the baby feeding from the bottle.

SUMMARY OF THE INVENTION

The instant invention overcomes the difficulties noted above with respect to prior an devices by providing a simple, light weight, easily installed bottle grip which can be placed upon current cylindrical shaped bottle systems or the older hexagonal bottles. The device is flexible to accommodate a wide range of bottle diameters or configurations and permits the baby to grip and manipulate the bottle or allow the bottle to be placed on a surface in a generally fixed position.

An outer rim outer surface is formed with a number of flat portions, for example, six in the form of a hexagon so that the grip will not roll when placed upon a flat hard surface. A number of fingers extend from the inner surface of the outer rim towards the grip center. The free ends of the fingers generally describe a circular bottle receiving passageway which can accept cylindrical bottle systems and many regular geometrical shaped cross-section bottles. Because the fingers are resilient and portions are crowed, the fingers are able to deflect to engage different shaped and dimensioned bottles. The outer rim is of small cross-section, permitting the baby to securely grip the bottle grip and thus position a bottle placed therein and manipulate same as desired. It is an object of this invention to provide an improved bottle grip.

It is an object of this invention rim to provide a lightweight easily installed bottle grip.

It is another object of this invention to provide a bottle grip which can be installed on a wide range of bottle sizes and shapes.

It is yet another object of this invention to provide a bottle grip which permits a baby to support and manipulate a bottle from which it is to feed.

It is another object of this invention to provide a bottle grip which when installed upon a bottle prevents the bottle from rolling along a surface.

Other objects and features of the invention will be pointed out in the following description and claims and illustrated in the accompanying drawings, which disclose, by way of example, the principles of the invention, and the best mode which is presently contemplated for carrying it out.

BRIEF DESCRIPTION OF THE DRAWING

In the drawing in which similar elements are given similar reference characters.

DESCRIPTION OF THE PREFERRED EMBODIMENT

Figure 1:
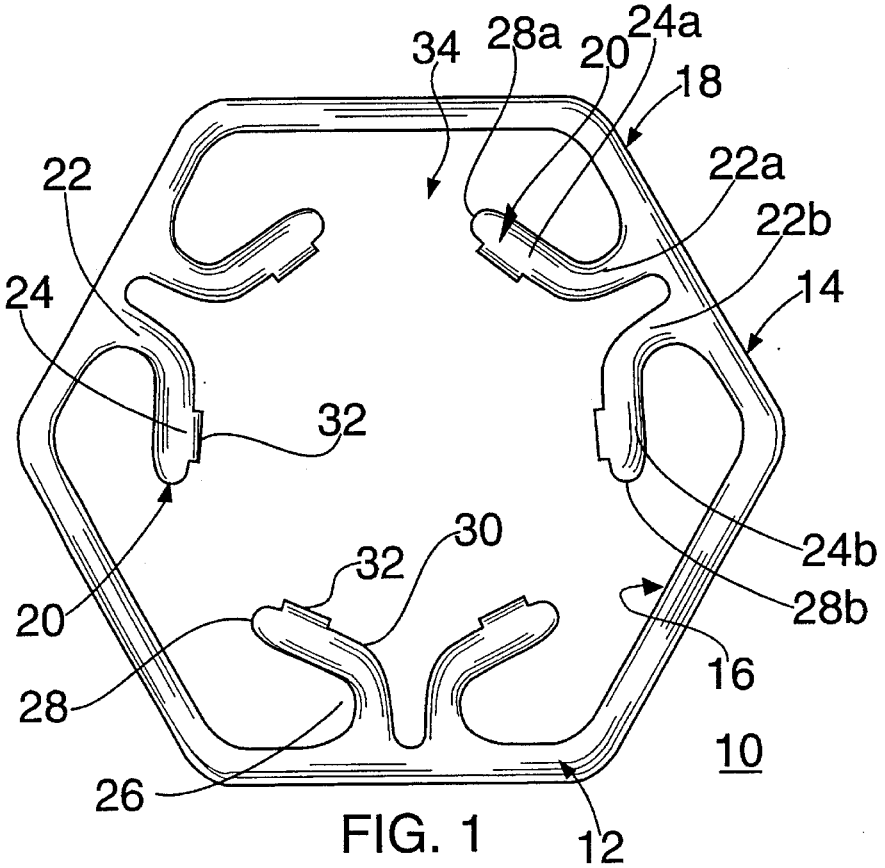
FIG. 1 is a front elevational view of a bottle grip constructed in accordance with the concepts of the invention.

Turning now to FIG. 1 there is shown a front elevational view of a bottle grip 10 constructed according to the concepts of tile invention. Bottle grip 10 has an outer rim 12 having an outer surface 14 and an inner surface 16. The outer surface 14 has a number of flat portions 18, which in the illustrated bottle grip 10, are six, forming a regular hexagon but could number three or more. The purpose of the flat portions 18 is to prevent the bottle from rolling along a surface. The outer surface 14 could also be formed into an ellipse and, providing the length is much greater than the width, this would also prevent tile bottle grip rolling along a surface.

A series of fingers 20 extend from inner surface 16 of rim 12 towards the center of grip 10. The fingers 20 are arranged in pairs and the pairs are spaced along the inner surface 16. Each of the fingers 20 has a body portion 22 and an arm portion 24 connected to the body portion 22. The bottle grip 10 is fabricated from a resilient material such as natural or synthetic rubber, a thermostat or thermoplastic material and may be polypropylene. To make the fingers 20 more flexible so that they can conform to the periphery of a bottle inserted in grip 10, the body portion 22 is curved as at 26.

The end of a arm portion 24 is rounded as at 28, and the inner surface 30 of arm portions 24 have a contact pad 32 thereon. By minimizing the contact area to a pad 32 on each arm portion 24, the grip 10 will be able to accommodate the widest range of bottle sizes and shapes. The region within the grip 10 described by the contact pads 32 is the bottle receiving passageway 34. The body portions **22*a*, 22*b* of one pair of fingers 20 are curved in opposite directions and the arm portions 24*a*, 24*b* extend in opposite directions so that the rounded ends 28*a*, 28*b* are separated by a distance greater than the separations of body portions 22*a*, 22*b* at inner surface 16** so that a large portion of a bottle periphery is enclosed.

Figure 2:
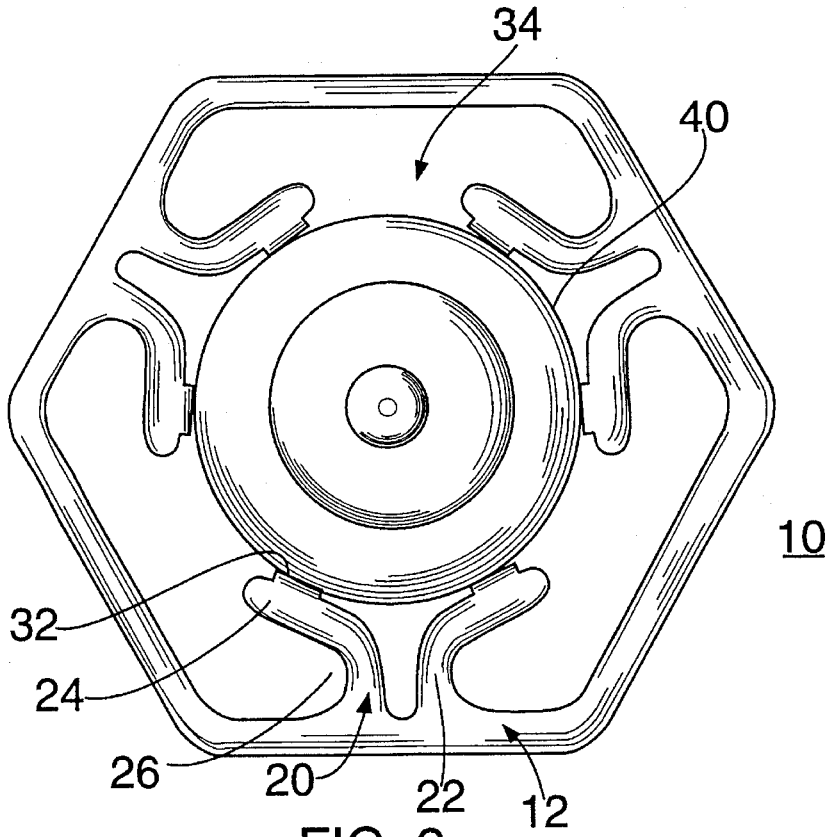
FIG. 2 is a front elevational view of the bottle grip of FIG. 1 installed upon a bottle having a circular cross-section.
Figure 3:
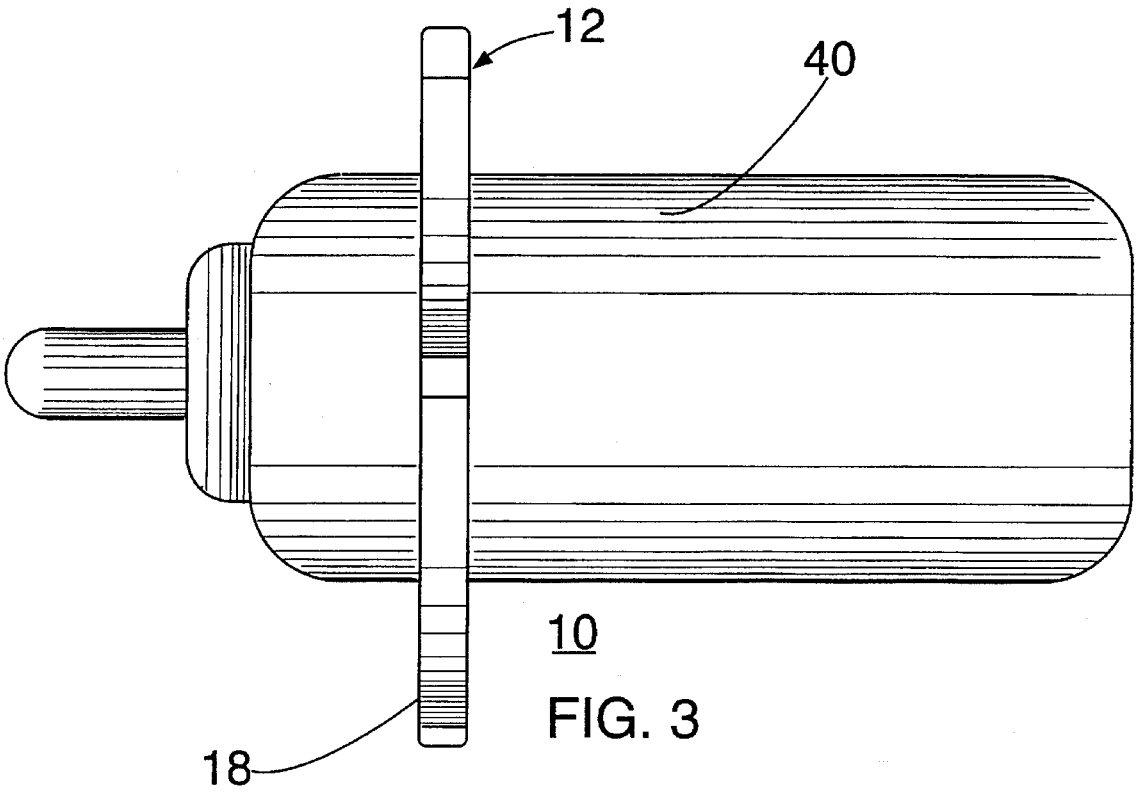
FIG. 3 is a side elevational view of the bottle grip and bottle of FIG. 2.

FIG. 2 and 3 show bottle grip 10 with a round bottle 40 in bottle receiving passageway 34. The individual arm portions 24 deflect as is necessary to place each of the contact pads 32 in contact with the periphery of bottle 40. The bottle grip 10, as is evident in FIG. 3, is not very thick and the cross-section of outer rim 12 is small permitting a small hand to close about it to hold grip 10 and manipulate it. Typically, the width of grip 10 from the outer surface 14 of outer rim 12 at the bottom of FIG. 2 across the center to the opposite outer surface 14 of outer rim 12 at the top of FIG. 2 is about 3.7 inches and the thickness is between 0.188 and 0.250 inches. The diameter of the bottle receiving passageway 34 is about 2.125 inches and the width of outer rim 12 from inner surface 16 to outer surface 14 is approximately 0.625 inches.

Figure 4:
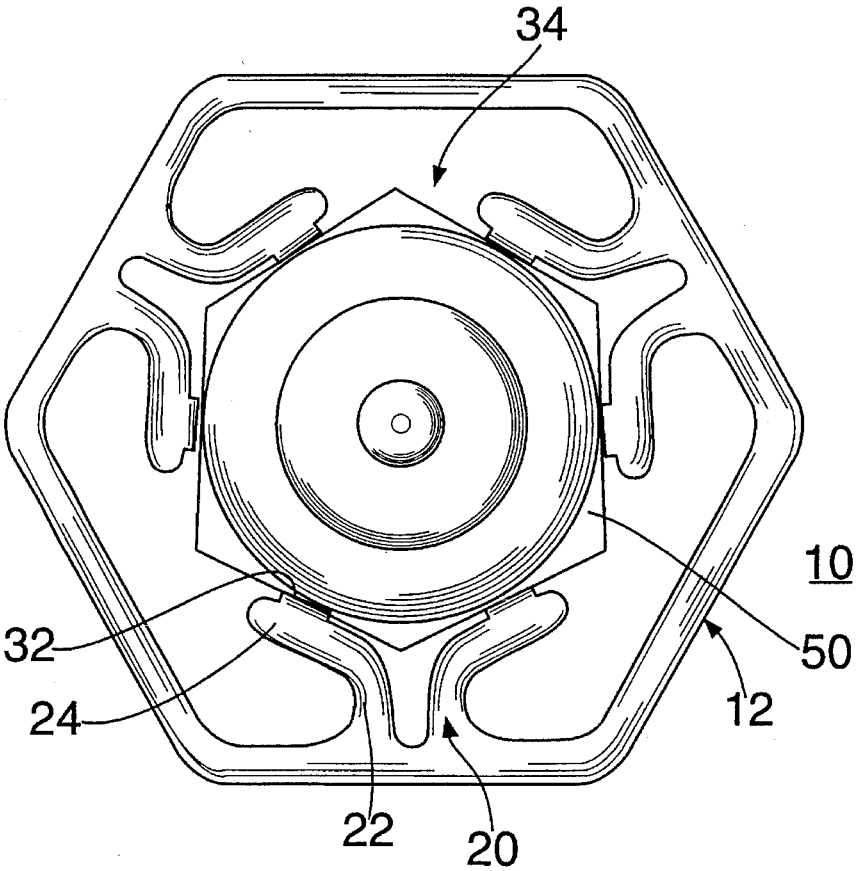
FIG. 4 is a front elevational view of the bottle grip of FIG. 1 installed upon a bottle having a hexagonal cross-section.

FIG. 4 shows a hexagonal bottle 50 inserted into the bottle receiving passageway 34. The fingers 20 have flexed so that the contact pads 32 have been seated upon sides of the bottle 50. It is not necessary that all contact pads 32 engage the periphery of the bottle. Under certain conditions only one of the contact pads 32 of the finger pairs may engage the bottle periphery.

While there have been shown and described and pointed out the fundamental novel features of the invention a applied to the preferred embodiment, it will be understood that various omissions and substitutions and changes of the form and details of the device illustrated and in its operation may be made by those skilled in the art, without departing from the spirit of the invention.

The embodiments of the invention in which an exclusive property or privilege is claimed are defined as follows:

1. A bottle grip which can be selectively installed about a portion of the outer periphery of a bottle to permit said bottle to be gripped and manipulated comprising:

a) an outer rim forming a closed loop about the periphery of said bottle and extending in a plane transverse to the longitudinal axis of said bottle, said outer rim having an outer surface and an inner surface spaced from one another along said plane;

b) a plurality of deflectable fingers extending inwardly from said inner surface of said rim towards the center of said grip:

c) said outer surface of said outer rim having a configuration to prevent said bottle grip from rolling along a surface upon which said bottle grip installed upon a bottle is placed;

d) each of said fingers has a body portion having a first end which is integral with said inner surface of said outer rim and a second end, and an arm portion having a first end integral with said second end of said body portion and a second free end describing a portion of a bottle receiving passageway; and said arm portions of each of said fingers extend at an angle to its corresponding body portion.

2. A bottle grip which can be selectively installed about a portion of the outer periphery of a bottle to permit said bottle to be gripped and manipulated comprising:

a) an outer rim forming a closed loop about the periphery of said bottle and extending in a plane transverse to the longitudinal axis of said bottle, said outer rim having an outer surface and an inner surface spaced from one another along said plane;

b) a plurality of deflectable fingers extending inwardly from said inner surface of said rim towards the center of said grip;

c) said outer surface of said outer rim having a configuration to prevent said bottle grip from rolling along a surface upon which said bottle grip installed upon a bottle is placed;

d) each of said fingers has a body portion having a first end which is integral with said inner surface of said outer rim and a second end, and an arm portion having a first end integral with said second end of said body portion and a second free end describing a portion of a bottle receiving passageway;

e) said fingers being arranged in pairs: and f) said arm portions of each of said fingers extend at an angle to its corresponding body portion and the arm portions of each of said pairs extend in opposite directions.

3. A bottle grip as defined in claim 2, wherein said body portions are curved to permit said arm portions to flex to accommodate the outer periphery of a bottle inserted into said passageway.

4. A bottle grip as defined in claim 2, wherein said arm portions describe a generally circular passageway.

* * * * *